US007357078B2

(12) United States Patent
Hertzog

(10) Patent No.: US 7,357,078 B2
(45) Date of Patent: Apr. 15, 2008

(54) METHOD FOR MAKING A MULTILAYER PRINTING BLANKET AND RESULTING BLANKET

(75) Inventor: Denis Hertzog, Berrwiller (FR)

(73) Assignee: MacDermid Graphic Arts S.A., Cernay (FR)

( * ) Notice: Subject to any disclaimer, the term of this patent is extended or adjusted under 35 U.S.C. 154(b) by 0 days.

(21) Appl. No.: 10/305,156

(22) Filed: Nov. 27, 2002

(65) Prior Publication Data

US 2003/0140805 A1 Jul. 31, 2003

Related U.S. Application Data

(63) Continuation-in-part of application No. PCT/FR01/01679, filed on May 30, 2001.

(30) Foreign Application Priority Data

May 31, 2000 (FR) ..... 00 07065

(51) Int. Cl.
*B41F 7/02* (2006.01)
*B41F 13/10* (2006.01)

(52) U.S. Cl. ..... 101/217; 101/376; 101/379; 101/401.1

(58) Field of Classification Search ..... 101/379, 101/217, 401.1, 376, 375
See application file for complete search history.

(56) References Cited

U.S. PATENT DOCUMENTS 4,093,764 A * 6/1978 Duckett et al. ..... 428/113
4,287,827 A * 9/1981 Warner ..... 101/141
4,380,196 A * 4/1983 Kato et al. ..... 101/453
4,401,494 A * 8/1983 Pernicano et al. ..... 156/155
4,491,855 A * 1/1985 Fujii et al. ..... 346/159
5,213,042 A * 5/1993 Larios ..... 101/450.1
5,249,525 A * 10/1993 Lewis et al. ..... 101/453
5,327,169 A * 7/1994 Thompson ..... 346/155
5,553,845 A * 9/1996 Sawa et al. ..... 271/314
5,620,775 A * 4/1997 LaPerre ..... 428/149
5,644,985 A * 7/1997 Serain et al. ..... 101/415.1
6,146,748 A * 11/2000 Risquez ..... 428/315.7
6,165,553 A * 12/2000 Chen et al. ..... 427/240
6,536,342 B2 * 3/2003 Rodgers ..... 101/379

FOREIGN PATENT DOCUMENTS

| | | |
|---|---|---|
| DE | 42 19 509 | 12/1993 |
| EP | 0224 365 | 6/1987 |
| EP | 0 511 543 | 11/1992 |
| EP | 0 571 909 | 12/1993 |
| EP | 0 676 301 | 10/1995 |

(Continued)

OTHER PUBLICATIONS

International Search Report for PCT/FR01/01679.

*Primary Examiner*—Daniel J. Colilla
*Assistant Examiner*—Marissa Ferguson-Samreth
(74) *Attorney, Agent, or Firm*—Leydig, Voit & Mayer, Ltd.

(57) ABSTRACT

A method for making a multilayer printing blanket whereof at least an outer layer is provided with embedded particles has the embedded in the surface of the outer layer by exerting pressure on said particles. Such a printing blanket is useful in the field of printing machines.

19 Claims, 3 Drawing Sheets

FOREIGN PATENT DOCUMENTS

| | | | |
|---|---|---|---|
| EP | 0 914 966 | | 5/1999 |
| FR | 2 748 422 | | 11/1997 |
| GB | 2 089 228 | | 6/1982 |
| GB | 2202763 | * | 10/1988 |
| JP | 58-167197 | | 10/1983 |
| JP | 10193828 | * | 7/1998 |
| JP | 63223156 | * | 9/1998 |
| WO | 93 09941 | | 5/1993 |
| WO | 97 00169 | | 1/1997 |
| WO | WO 97/00169 | * | 1/1997 |

* cited by examiner mm
1 mm
0 mm
5
4
3
6
1
2 mm
1 mm
0 mm
5
4
3
1
2 mm
1 mm
0 mm
5
4
3
1
2

METHOD FOR MAKING A MULTILAYER PRINTING BLANKET AND RESULTING BLANKET

RELATED APPLICATIONS

This is a Continuation-in-Part of PCT/FR01/01679, filed 30 May 2001, which published in French as WO 01/92027.

This application is related to U.S. application Ser. No. 10/304,750, filed on even date herewith, which is a Continuation-in-Part of PCT/PR01/01678 and is entitled "Method of Making a Printing Blanket and Resulting Blanket".

This application is related to U.S. application Ser. No. 10/305,155, filed on even date herewith, which is a Continuation-in-Part of PCT/FR01/01680 and is entitled "Method for Making A Printing Blanket Comprising A Back Layer Made Of A Polymer Material And Resulting Blanket".

BACKGROUND

1. Field of the Invention

The invention concerns a method of making a multilayer printing blanket at least an outer layer of which is provided with embedded particles and a resulting blanket.

2. Background of the Invention

Making the surface of the lithographic layer heterogeneous in order to obtain special transfer properties is already known. For example, in the document EP 0 224 365 it is proposed to embed particles in the surface and then to remove these particles by washing in order to create a cavo-relief that is capable of being inked. The document EP 0 511 543 describes a cylinder for a printing machine the outer oleophilic metal surface of which is embedded with a hydrophilic material, ceramic for example. Document FR 2 748 422 shows the possibility of obtaining heterogeneity of the transfer surface by photochemical grafting.

All of these known methods have in common the major disadvantage of requiring complicated implementation and of not being sufficiently effective.

SUMMARY OF THE INVENTION

In one aspect, the present invention is directed to a method for forming a multilayer printing blanket in which particles are embedded into a surface of a layer by applying pressure to the particles.

According to one characteristic of the invention, the particles are embedded by calendering.

According to another characteristic of the invention, in order to embed the particles, the polymer layer with the blanket carcass is made to pass between two calender rollers, and the calender roller in contact with the surface in which the embedding is to be done is caused to pass through a receptacle containing the particles to be embedded, making these particles adhere to the surface of the roller.

In another aspect, the present invention is directed to a multilayer printing blanket having at least one outer layer provided with a surface having embedded particles therein, the multilayer printing blanket being formed, at least in part, by applying pressure to particles to embed them into the layer.

BRIEF DESCRIPTION OF THE DRAWINGS

The invention will be better understood, and other goals, characteristics, details and advantages thereof will appear more clearly in the explanatory description that will follow, given with reference to the attached schematic diagrams given solely by way of example, illustrating several forms of embodiment of the invention, and in which.

DETAILED DESCRIPTION OF THE PREFERRED EMBODIMENTS

Figure 1:
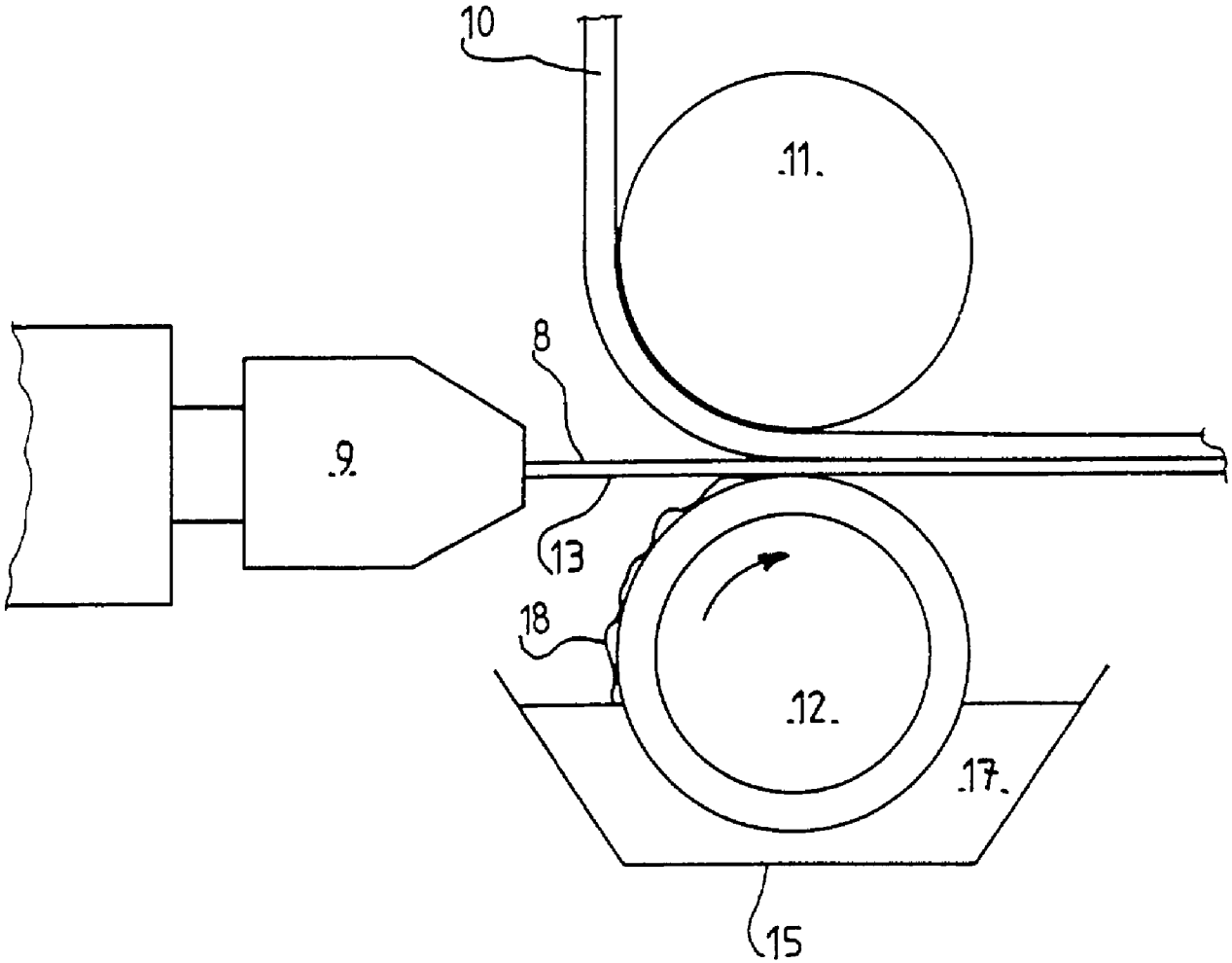
FIG. 1 is a schematic view showing a device for the implementation of the method according to the invention.

The device for the implementation of the method according to the invention, shown in FIG. 1, has, downstream from an extrusion die 9, two calendering rollers 11, 12 between which the polymer layer 8 produced by the die 9 and a blanket carcass 10 pass. The calendering roller 12, which comes in contact with the lower surface 13 on which the embedding is to be done, passes through a receptacle or trough 15, containing the particles to be embedded, indicated as 17. As the figure shows, the lower part of the cylinder dips into the trough of particles. In passing through the bath of these particles, the surface of the cylinder picks up, and is covered with a layer 18 of particles that it transports, while turning, to the layer 3 and embeds them in the surface thereof.

The temperature of the dipping cylinder 12, its roughness and the calendering pressure are parameters that control the quantity of particles deposited. The trough 15 can be given a vibration movement in order to ensure a regular deposit on the surface of the cylinder 12.

A scraping device for the dipping cylinder 12 can also be provided to proportion the quantity of particles deposited and embedded in the surface of the blanket.

A polymer layer 8 could be the lithographic layer of the blanket or the layer at the back thereof or one or both lithographic layers of a blanket having a lithographic layer on both outer faces. The layer on the back of the blanket is the layer on the face opposite to the face having the lithographic layer if the blanket has only one.

The particle could be of any appropriate type, enabling the desired transfer properties to be obtained. The particles could be glass microbeads, polymer or ceramic powders or anti-cling powders. Glass microbeads are particularly suitable for obtaining good adhesion of the water or affinity to the moistening water. PTFE particles make it possible to increase the anti-cling of the surface and polyamide particles enable the affinity to greasy inks to be improved.

By embedding glass microbeads, for example, in the polymer layer on the back of the blanket, on the surface, a reduction is obtained of the friction coefficient of the layer in contact with its support. A low friction coefficient facilitates the mounting of the blanket on the cylinder of the printing machine.

The surface embedding of the particles can also be obtained by transfer by an electric field followed by fixing by calendering or similar, with heating. Adhesion of the particles could also be achieved by gluing, followed by calendering.

In a variation of an embodiment, the embedding described here can be done on the surface of a previously extruded polymer film and, when applicable, rectified by simply heating of the surface thereof using known means, such as infrared banks, and passing the blanket with its layer of heated polymer on the surface between the rolls of the calender of FIG. 1.

As a variation, a film could also be deposited of liquid or pasty or doughy product containing particles which, driven by the dipping cylinder, are immobilized in contact with the hot polymer film on the surface of the blanket when it passes through the contact zone between the two rollers of the calender.

The diameter of the particles is preferably between 1 and 50μ. Indeed, if the diameter is too large, the quality of printing deteriorates. If the diameter is too small, the implementation of the embedding becomes difficult.

The invention makes it possible to produce a blanket that can have advantageous features in addition to those mentioned above.

According to the invention, a blanket having on the back a layer of polymer material can be precision ground to make the blanket thickness more uniform, while preserving or improving the printing properties and qualities.

In particular, the rectification of the polymer layer on the back makes it possible to regulate the thickness of blankets with precision ground and buffed lithographic layer and blankets with smoother surface obtained by molding, and because of this, having excellent printing quality.

However, in general, the rectification is applicable to all blankets the thickness of which should be made uniform, regardless of the means used to produce a lithographic surface that ensures good printing quality.

Compared to a blanket without rectification, the invention therefore makes it possible to obtain a gain in precision by a factor of 2, that is, an overall thickness tolerance of ±0.01 mm compared to about ±0.02 mm according to the current status of the technology.

In addition to the uniformity of thickness of the blanket, the invention also makes it possible to obtain a reduction in the total thickness of the blanket. In fact, by separating the different functions to be accomplished by the blanket, and by allocating these functions to specific layers, an optimal structure of the blanket can be established by assembling layers of fabric, compressible layers and the lithographic layer. It has been established that the use of a beam or a thread or a woven grid makes it possible to replace several fabrics and thus to obtain a reduction in thickness. The use of a beam of Aramid type fibers, for example, makes it possible to economize on the relative thickness by at least one fold of fabric. The gain is at least 0.5 mm.

Because the beam replaces reinforcement fabrics that contribute to the compressibility of the blanket, this compressibility is maintained in spite of the fact that fabric was removed, by making the polymer layer on the back compressible as a result.

Thus the invention allows a blanket to be made with a practically uniform thickness of 1.00 to 1.30 mm while preserving the breaking strength of known blankets.

The invention enables a blanket to be produced that has, from the interior toward the exterior, the following layers: a layer of slightly compressible polymer, an Aramid or equivalent beam in the warp direction, a main compressible layer, a stabilization fabric with, for example, monofilaments in the weft direction and flexible warp and a lithographic layer.

In a first variation, the stabilization fabric can be replaced by a layer of hard polymer possibly reinforced by fibers, and in a second variation, the compressible layer or layers can be made anisotropic by incorporating fibers oriented in the plane of the blanket. In this case, the stabilization layer can be omitted, with an additional reduction of thickness.

FIGS. 2 to 7 show the structure of six advantageous embodiments of a blanket according to the invention, having a reduced thickness. In these figures, reference number 1 designates a layer of slightly compressible polymer, number 2 a beam, number 3 a compressible layer, number 4 a stabilization fabric or a hard reinforced layer, number 5 a lithographic layer and number 6 a compact polymer layer.

Figure 2:
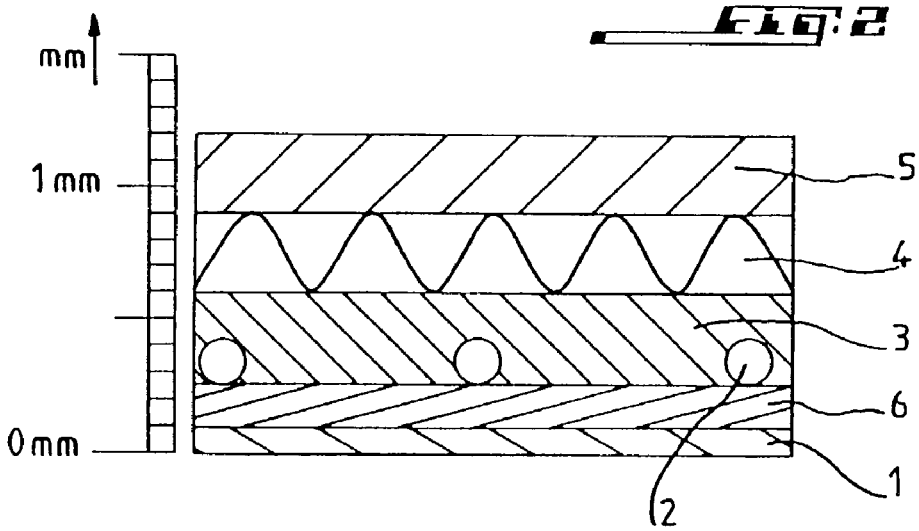
FIG. 2 is a cross sectional view of a first embodiment of a blanket according to the invention.

The blanket shown in FIG. 2 has, from the interior to the exterior, a layer of slightly compressible polymer 1, a compressible layer 3 into which the beam 2 is integrated, a stabilization fabric or hard reinforced layer 4, and a lithographic layer 5. The blanket has a thickness of about 1.2 mm.

Figure 3:
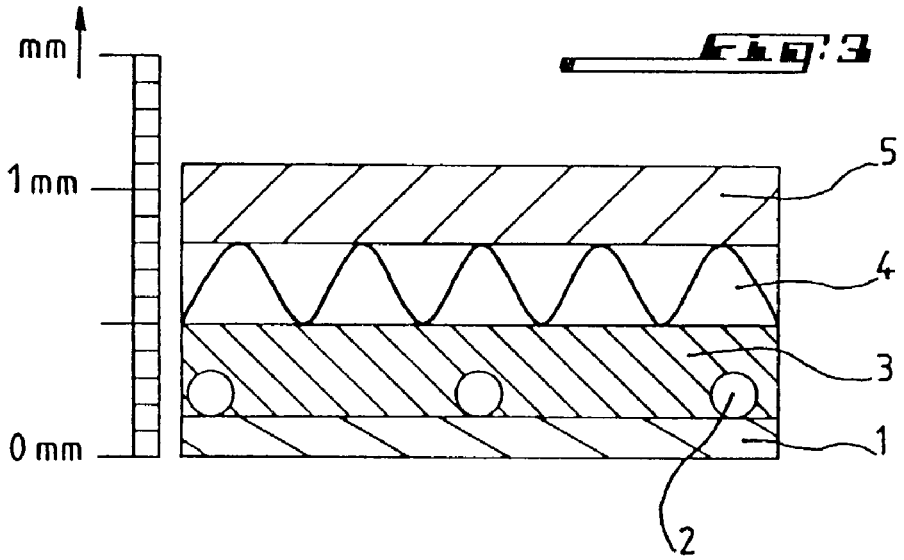
FIG. 3 is a cross sectional view of a second embodiment of a blanket according to the invention.

In the blanket according to FIG. 3, the compact polymer layer shown in FIG. 2 is left out, which allows the thickness of the blanket to be reduced to about 1.1 mm.

Figure 4:
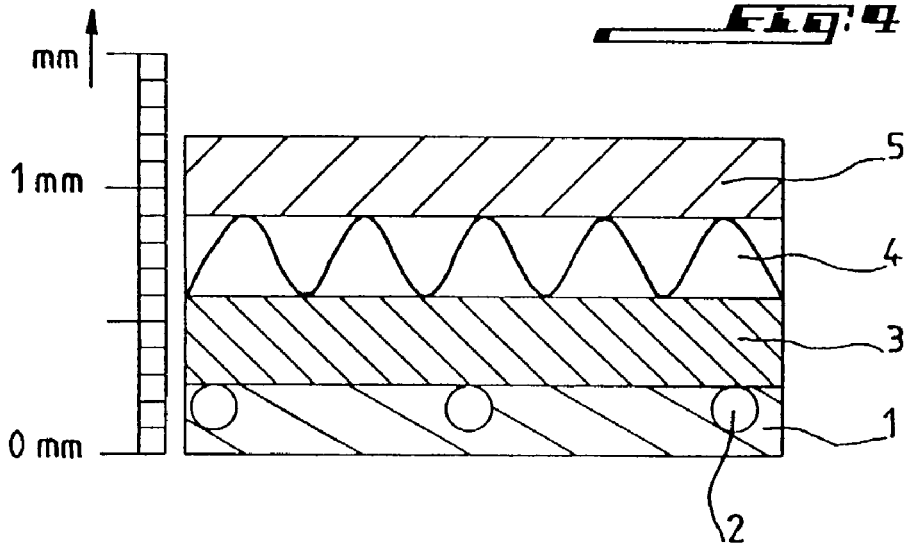
FIG. 4 is a cross sectional view of a third embodiment of a blanket according to the invention.

FIG. 4 shows a blanket in which the beam 2 is integrated into the polymer layer at the back of the blanket, the compact polymer layer 6 also being left out. The thickness of the blanket is about 1.2 mm.

Figure 5:
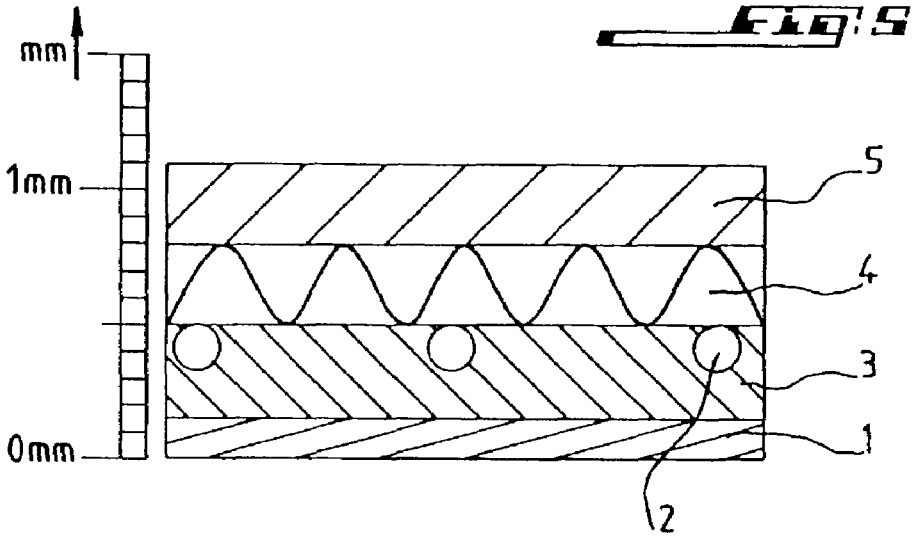
FIG. 5 is a cross sectional view of a fourth embodiment of a blanket according to the invention.

The blanket in FIG. 5 corresponds to the one in FIG. 4, the difference being that the beam 2 is integrated into the upper part of the compressible layer. The thickness of the blanket is 1.1 mm.

Figure 6:
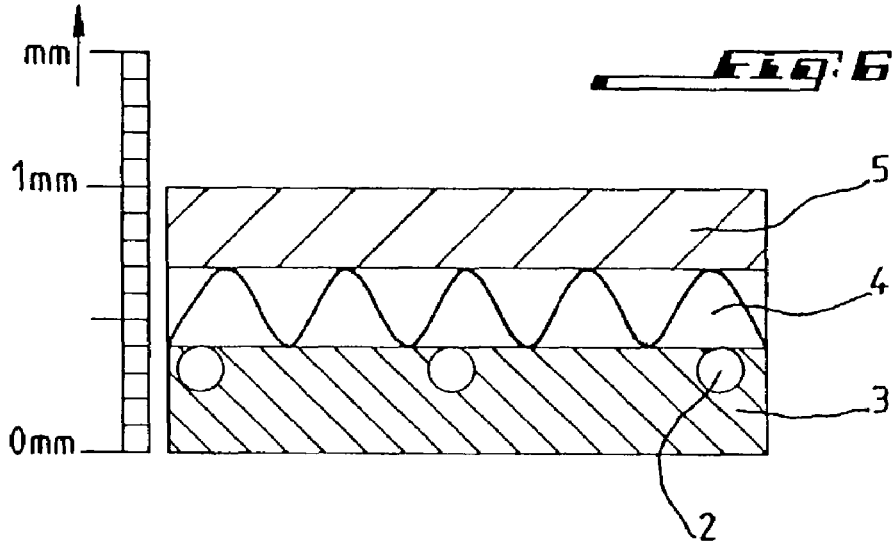
FIG. 6 is a cross sectional view of a fifth embodiment of a blanket according to the invention.

The blanket shown in FIG. 6 has an even smaller thickness of about 1 mm due to the fact that the layers 1 of compressible polymer and the layer 6 of compact polymer have been omitted, the assembly 2 being integrated into the upper part of the compressible layer 3.

Figure 7:
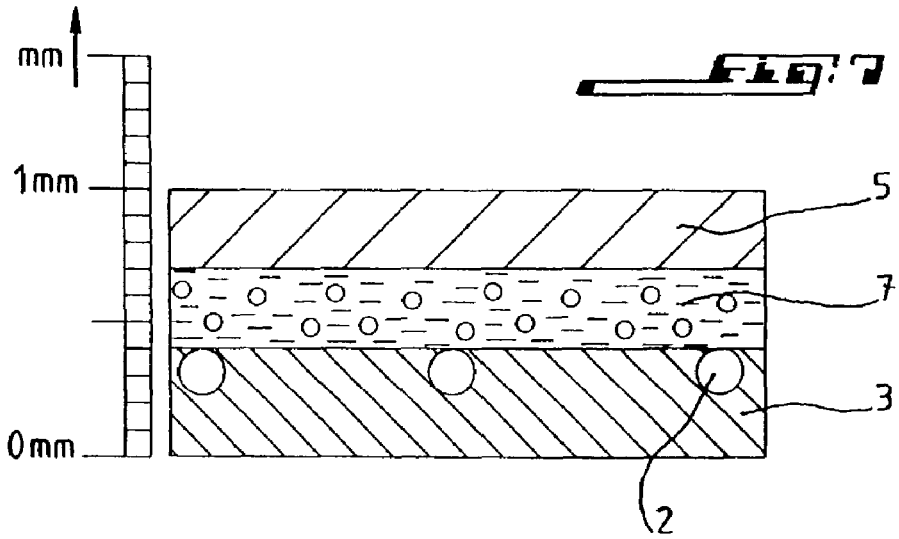
FIG. 7 is a cross sectional view of a sixth embodiment of a blanket according to the invention.

Finally, FIG. 7 shows a blanket having at the back a compressible layer 3 with the beam integrated into the upper part thereof, an anisotropic compressible layer 7 and a lithographic layer 5. The thickness of this blanket is also about 1 mm.

According to another feature of the invention, by using for the structure of the different layers materials and means of assembly of the layers that do not involve the use of solvents, blankets can be obtained that do not represent any hazard to man and the environment. The different layers of the blankets can be made to adhere to each other by corona, ionization or flame treatment.

Specifically, the elastomers used within the scope of the invention have the special characteristic that they do not contain thermal cross-linking agents. They are thermoplastic in nature with a suitable rheology, and the different layers may be cross-linked by radiation after assembly of all or part of the blanket.

The materials used have the property of becoming fluid at high temperature, and thus make possible the creation of thin films of good quality, in particular by extrusion.

Examples of elastomers and reinforcements that can be used in blankets according to the invention are formulations of TPU type elastomers in association with other polymers, PP, PAN and PVC based dynamic vulcanization elastomers, elastomers of the styrene family, elastomer formulations of the olefin family, olefin copolymers and functionalized olefins, elastomers of the acrylonitrile family, EPDMs or CSMs, Aramid type fiber or thread reinforcements, polyethylene or polypropylene type fiber or thread reinforcements, polyester type fiber or thread reinforcements or mixtures of such fibers or such threads.

Because of their thermoplastic implementation and therefore their property of fusing simply by heating at high temperature to create perfect joints, materials with no solvents and thus not hazardous to man or the environment used within the scope of the invention, can be used to produce tubular blankets.

Thus, for example, a tubular lithographic layer can be produced from a lithographic layer obtained by extrusion and cut to the appropriate length, and after beveling the ends, by rolling this layer onto a support sleeve, overlapping the beveled ends and heating them. This layer could be cross-linked by radiation, where appropriate, then precision ground and buffed. It could be embedded with particles on the surface. The support sleeve in this case could be the layer of the blanket on which the lithographic layer lies. A compressible layer could be made of a similar material with the additional possibility of ensuring the expansion of this layer during the assembly of the ends as a result of the expandable microbeads previously incorporated in the materials forming the layer. The extruded film intended to become a compressible layer could advantageously include fibers that will be oriented in the plane during extrusion in order to confer anisotropic properties to the layer. An extruded film having oriented fibers can also function as a reinforcing or stabilization or paper flow control layer.

The invention achieves numerous advantages. As a result of the rectification of the polymer layer at the back of the blanket, the thickness of said blanket is more precise and uniform. This has a direct impact on the performance of the blankets. Indeed, a controlled thickness improves the printing quality and the durability of the blankets.

The excellent printing quality obtained by a smooth, and even very smooth, printing surface can be preserved. Such type of smooth surface allows details to be printed accurately and makes it possible to generate so-called "pointue" printing or "high fidelity" printing. It allows the use of a stochastic screen. The smooth surface can be characterized by a very low roughness, with an Ra (average roughness measured by a profilometer) of less than 0.4μ compared to values of 0.8 to 1.5μ for blankets using conventional technology. The deterioration of the regularity of the thickness when a very smooth printing surface is desired, for example by buffing said surface, and the compromise made for known blankets being satisfied with a less heavy-duty buffing and therefore a less smooth surface, can be discontinued thanks to the rectification of the layer at the back, as proposed by the invention.

The reduction of the thickness of the blankets results in a reduction of vibration by allowing cylinders to be designed with narrow gaps for attaching the blanket and thus minimizing bouncing during rolling at high speed. Moreover, the invention ensures a reduction in cost in so far as a thin blanket requires less material to produce, materials being the largest portion of the cost of production.

The invention also makes it possible to reduce the quantity of waste. Indeed, thinner blankets mean a smaller quantity of waste to be eliminated. Finally, by embedding particles in the surface of the lithographic layer, or the layer at the back, it is possible to obtain a desired micro-hetero-roughness of surface and/or reduce the friction of the blanket on the support. A low coefficient of friction is very useful in facilitating the attaching of the blanket on the cylinder of the printing machine. A thin blanket according to the invention also has the following advantages: reduction of paper waste on press; possibility of implementing innovative tensioning systems; increased folding flexibility, facilitating rolling the blanket on at the attachment gap and printing can be done as close as possible to said gap.

What is claimed is:

1. A method of making a multilayer printing blanket having a layer with a surface that is an outer surface of the printing blanket and in which particles of a solid are embedded, the method comprising:

forming a multi layer printing blanket having a layer with a surface forming an outer surface of the printing blanket and into which particles of a solid material are to be embedded;

rotating a first calender roller partially disposed in a receptacle containing the particles of the solid material to be embedded in the outer surface of the layer of the printing blanket, so that a plurality of the particles of the solid material are attached along all of the first calender roller as the first calender roller rotates through the receptacle; and passing the layer having the outer surface over and in contact with the first calender roller to transfer the particles of the solid material to all of the surface of the layer, while passing the layer between the first calender roller and a second calender roller positioned relative to the first calender roller to calender the layer and force the particles on the surface into the layer.

2. The method according to claim 1, comprising vibrating the receptacle while the first calender roller rotates partially within the receptacle and is in contact with the particles of the solid material.

3. The method according to claim 1, wherein the particles of the solid material are glass microbeads.

4. The method according to claim 1, further comprising forming, on the calender roller, a film comprising a liquid, pasty, or doughy product containing the particles of the solid material.

5. The method according to claim 4, comprising vibrating the receptacle while the first calender roller rotates partially within the receptacle.

6. The method according to claim 1, wherein the outer surface of the printing blanket comprises one of a lithographic surface for printing and a back surface opposite the lithographic surface of the printing blanket.

7. The method according to claim 6, including embedding the particles of the solid material in the back surface.

8. A multilayer printing blanket comprising a lithographic surface for printing and a back surface opposite the lithographic surface, the lithographic surface and the back surface both being outer surfaces of the printing blanket, glass microbeads embedded in and distributed over all of the back surface of the printing blanket, and particles of solid materials embedded in and distributed over all of the lithographic surface of the printing blanket, wherein the embedded particles of the solid materials include glass microbeads and particles selected from the group consisting of a polymer powder, a ceramic powder, an anti-cling powder, and mixtures thereof.

9. The multilayer printing blanket according to claim 8, wherein the embedded particles of the solid material have diameters ranging between 1 and 50 microns.

10. The multilayer printing blanket according to claim 8, further comprising a reinforcement selected from the group consisting of a beam reinforcement, a thread, a woven grid, and combinations thereof.

11. The multilayer printing blanket according to claim 10, comprising a beam reinforcement of aramid fibers.

12. The multilayer printing blanket according to claim 8, comprising thermoplastic elastomer layers free of cross-linking agents.

13. The multilayer printing blanket according to claim 8, wherein layers of the multilayer printing blanket are attached to each other without the use of solvents.

14. The multilayer printing blanket according to claim 8 having a tubular shape.

15. The multilayer printing blanket according to claim 14, comprising first and second ends, wherein the first and second ends are fused together to form the tubular shape.

16. The multilayer printing blanket according to claim 8 wherein the particles of the solid material are embedded in the back surface.

17. The multilayer printing blanket according to claim 16, wherein the back surface comprises a rectified layer of a polymer material.

18. The multilayer printing blanket according to claim 16, wherein the back surface comprises a compressible polymer layer.

19. The multilayer printing blanket according to claim 8, wherein the lithographic surface has an average roughness value of less than 0.4 μm.

* * * * *